US008875936B2

(12) United States Patent
Turner et al.

(10) Patent No.: US 8,875,936 B2
(45) Date of Patent: Nov. 4, 2014

(54) CAN END WITH NEGATIVELY ANGLED WALL

(75) Inventors: Timothy L. Turner, Port Charlotte, FL (US); Randall G. Forrest, Park Ridge, IL (US)

(73) Assignee: Rexam Beverage Can Company, Chicago, IL (US)

( * ) Notice: Subject to any disclaimer, the term of this patent is extended or adjusted under 35 U.S.C. 154(b) by 997 days.

(21) Appl. No.: 11/738,206

(22) Filed: Apr. 20, 2007

(65) Prior Publication Data

US 2008/0257900 A1 Oct. 23, 2008

(51) Int. Cl.
*B65D 17/34* (2006.01)

(52) U.S. Cl.
USPC ..... 220/619; 220/623

(58) Field of Classification Search
USPC ..... 220/623, 619
See application file for complete search history.

(56) References Cited

U.S. PATENT DOCUMENTS

| | | | | |
|---|---|---|---|---|
| 2,767,899 | A * | 10/1956 | Brown | 229/5.6 |
| 3,186,583 | A | 6/1965 | Zundel | |
| 3,434,623 | A | 3/1969 | Cookson | |
| 3,525,455 | A | 8/1970 | Saunders | |
| 3,705,563 | A | 12/1972 | Elser | |
| 3,765,352 | A | 10/1973 | Schubert et al. | |
| 3,837,524 | A | 9/1974 | Schubert et al. | |
| 3,853,080 | A | 12/1974 | Zundel | |
| 3,868,919 | A | 3/1975 | Schrecker et al. | |
| 3,871,314 | A | 3/1975 | Stargell | |
| 3,905,513 | A | 9/1975 | Klein | |
| 3,941,277 | A | 3/1976 | McKinney et al. | |
| 3,945,334 | A | 3/1976 | Ostrem et al. | |
| 3,990,376 | A | 11/1976 | Schubert et al. | |
| 4,031,837 | A | 6/1977 | Jordan | |
| 4,055,134 | A | 10/1977 | Ostrem et al. | |
| 4,084,721 | A | 4/1978 | Perry | |
| 4,093,102 | A | 6/1978 | Kraska | |
| 4,116,361 | A | 9/1978 | Stargell | |
| 4,217,843 | A | 8/1980 | Kraska | |
| 4,262,815 | A | 4/1981 | Klein | |
| 4,324,343 | A | 4/1982 | Moller | |
| 4,434,641 | A | 3/1984 | Nguyen | |
| 4,448,322 | A | 5/1984 | Kraska | |
| 4,571,978 | A | 2/1986 | Taube et al. | |

(Continued)

FOREIGN PATENT DOCUMENTS

| | | |
|---|---|---|
| AU | 107340 | 5/1939 |
| DE | 2303943 | 5/1974 |

(Continued)

OTHER PUBLICATIONS

International Search Report and Written Opinion for PCT/US08/060744 mailed Jul. 14, 2008.

*Primary Examiner* — Stephen Castellano
(74) *Attorney, Agent, or Firm* — Ungaretti & Harris LLP

(57) ABSTRACT

An end for a beverage can is described. The end has a product side, an opposing public side, a center panel, an annular countersink, a circumferential wall, and a curl. The center panel has a means for opening the end. The annular countersink extends circumferentially about the center panel. The circumferential wall extends upwardly from the countersink and has an angled portion extending radially inwardly toward the center panel. The curl is located radially outward relative to the center panel and defines an outer perimeter of the end.

12 Claims, 1 Drawing Sheet

(56) References Cited

U.S. PATENT DOCUMENTS

| | | | | |
|---|---|---|---|---|
| 4,577,774 | A | 3/1986 | Nguyen | |
| 4,641,761 | A | 2/1987 | Smith et al. | |
| 4,680,917 | A | 7/1987 | Hambleton et al. | |
| 4,685,849 | A | 8/1987 | LaBarge et al. | |
| 4,704,887 | A | 11/1987 | Bachmann et al. | |
| 4,722,215 | A | 2/1988 | Taube et al. | |
| 4,775,071 | A * | 10/1988 | Giggard | 220/619 |
| 4,804,106 | A | 2/1989 | Saunders | |
| 4,832,223 | A | 5/1989 | Kalenak et al. | |
| 4,991,735 | A | 2/1991 | Biondich | |
| 5,069,355 | A | 12/1991 | Matuszak | |
| 5,105,977 | A | 4/1992 | Taniuchi | |
| 5,143,504 | A | 9/1992 | Braakman | |
| 5,149,238 | A | 9/1992 | McEldowney et al. | |
| 5,174,706 | A | 12/1992 | Taniuchi | |
| 5,346,087 | A | 9/1994 | Klein | |
| 5,823,730 | A | 10/1998 | La Rovere | |
| 5,950,858 | A | 9/1999 | Sergeant | |
| 5,964,366 | A | 10/1999 | Hurst et al. | |
| 6,024,239 | A | 2/2000 | Turner et al. | |
| 6,065,634 | A | 5/2000 | Brifcani et al. | |
| 6,089,072 | A | 7/2000 | Fields | |
| 6,234,337 | B1 | 5/2001 | Huber et al. | |
| 6,419,110 | B1 | 7/2002 | Stodd | |
| 6,460,723 | B2 | 10/2002 | Nguyen et al. | |
| 6,499,622 | B1 | 12/2002 | Neiner | |
| 6,516,968 | B2 | 2/2003 | Stodd | |
| 6,561,004 | B1 | 5/2003 | Neiner et al. | |
| 6,702,142 | B2 | 3/2004 | Neiner | |
| 6,736,283 | B1 | 5/2004 | Santamaria et al. | |
| 6,772,900 | B2 | 8/2004 | Turner et al. | |
| 6,848,875 | B2 | 2/2005 | Brifcani et al. | |
| 6,877,941 | B2 | 4/2005 | Brifcani et al. | |
| 6,935,826 | B2 | 8/2005 | Brifcani et al. | |
| 7,004,345 | B2 | 2/2006 | Turner et al. | |
| 7,036,348 | B2 | 5/2006 | McClung | |
| 7,174,762 | B2 | 2/2007 | Turner et al. | |
| 7,278,548 | B2 | 10/2007 | Rieck et al. | |
| 7,370,774 | B2 | 5/2008 | Watson et al. | |
| 2001/0037668 | A1 | 11/2001 | Fields | |
| 2002/0050493 | A1 | 5/2002 | Ball et al. | |
| 2002/0158071 | A1 | 10/2002 | Chasteen et al. | |
| 2003/0042258 | A1 * | 3/2003 | Turner et al. | 220/269 |
| 2003/0121924 | A1 | 7/2003 | Stodd | |
| 2003/0173367 | A1 | 9/2003 | Nguyen et al. | |
| 2004/0065663 | A1 | 4/2004 | Turner et al. | |
| 2004/0074911 | A1 | 4/2004 | Stodd | |
| 2004/0140312 | A1 | 7/2004 | Neiner | |
| 2004/0200838 | A1 | 10/2004 | Turner et al. | |
| 2004/0206764 | A1 | 10/2004 | Gardiner | |
| 2004/0211780 | A1 | 10/2004 | Turner et al. | |
| 2004/0238546 | A1 | 12/2004 | Watson | |
| 2005/0006388 | A1 | 1/2005 | Turner et al. | |
| 2005/0006395 | A1 | 1/2005 | Reed | |
| 2005/0029269 | A1 | 2/2005 | Stodd et al. | |
| 2005/0115976 | A1 | 6/2005 | Watson | |
| 2005/0247717 | A1 | 11/2005 | Brifcani et al. | |
| 2005/0252922 | A1 | 11/2005 | Reed | |
| 2006/0071005 | A1 | 4/2006 | Bulso | |
| 2006/0096994 | A1 | 5/2006 | Turner et al. | |
| 2007/0007294 | A1 * | 1/2007 | Jentzsch et al. | 220/619 |

FOREIGN PATENT DOCUMENTS

| | | | |
|---|---|---|---|
| DE | 2554264 | | 6/1977 |
| DE | 8228681 | | 10/1983 |
| EP | 1497054 | | 11/2008 |
| GB | 422052 | | 6/1934 |
| JP | 2001151232 | A | 6/2001 |
| NL | 1013957 | C2 | 6/2001 |
| WO | WO 03016155 | | 2/1993 |
| WO | WO-9637414 | | 11/1996 |
| WO | WO-9834743 | | 8/1998 |
| WO | WO 0141948 | | 6/2001 |
| WO | WO 0200512 | | 1/2002 |
| WO | WO 0243895 | | 6/2002 |
| WO | WO 02057137 | | 7/2002 |
| WO | WO 02057148 | | 7/2002 |
| WO | 02068281 | A1 | 9/2002 |
| WO | WO-03/059764 | A1 | 7/2003 |
| WO | 2005113351 | A1 | 12/2005 |
| WO | 2005113352 | A1 | 12/2005 |
| WO | 2007005564 | A2 | 1/2007 |

* cited by examiner 10
12
14
16
18
20
22
24
26
28
30
32
34
38
40
42
50
54
58
62
64
68
72
76
80
84
2
2
θ
$H_{CP}$

CAN END WITH NEGATIVELY ANGLED WALL

TECHNICAL FIELD

The invention relates to ends or lids for beverage cans. More particularly, the present invention is directed to a can end having a circumferential wall formed to provide increased strength.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. Another goal of the manufacturers of can ends is to reduce the amount of metal in the blank which is provided to form the can end while at the same time maintaining the strength of the end. A number of recent disclosures, including U.S. Pat. Nos. 6,736,283, 6,460,723, 6,516,968, 6,419,110, 6,065,634, 6,848,875, 6,877,941, 6,935,826, 6,561,004, 6,499,622, 6,702,142, and US Publication Nos. 2004/0074911, 2003/0121924, 2004/0238546, 2005/0115976, 2005/0247717, 2005/0252922, 2005/0006395, 2004/0140312, 2003/0173367, 2002/0158071, 2005/0029269, are directed to achieving these goals by altering the angles and/or orientations of the chuck wall.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

The present invention is directed to an end for a beverage can. The end has a product side and an opposing public side.

The end comprises a center panel including a means for opening the end, an annular countersink extending circumferentially about the center panel, a circumferential wall extending upwardly from the countersink, and a curl located radially outward relative to the center panel. The curl defines an outer perimeter of the end. The circumferential wall has an angled portion extending radially inwardly toward the center panel.

The angle of the angled portion is greater than 0 degrees as measured from a vertical axis. The angle may be greater than 25 degrees, between 10 and 90 degrees, between 20 and 90 degrees, between 25 and 90 degrees, or between 60 and 90 degrees.

The annular countersink has a first portion extending downwardly relative to a radially outer edge of the center panel, an arcuate second portion extending radially outwardly and downwardly relative to the first portion, and an arcuate third portion extending upwardly relative to a lowermost end of the arcuate second portion. A lowermost end of the circumferential wall is joined to the third portion. The angled portion is located between the lowermost end of the circumferential wall and an uppermost end of the circumferential wall joined to the curl.

The angled portion of the circumferential wall is angled towards the first portion of the countersink wherein a distance between the circumferential wall and the first portion of the annular countersink is reduced along a length of the angled portion. The angled portion is bounded by a first bend interconnected to a second bend. The first bend is inwardly concave relative to the public side of the end, and the second bend is outwardly convex relative to the public side of the end.

An angle of the first portion of the annular countersink may not be equal to an angle of the angled portion of the circumferential wall.

A length of the angled portion is less than a length of the first portion of the annular countersink.

The central panel has a height measured from a lowermost point on the annular countersink to the product side of a peripheral edge of the central panel. A lowermost end of the angled portion of the circumferential wall has a height less than the height of the center panel.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figures 1, 2, 3:
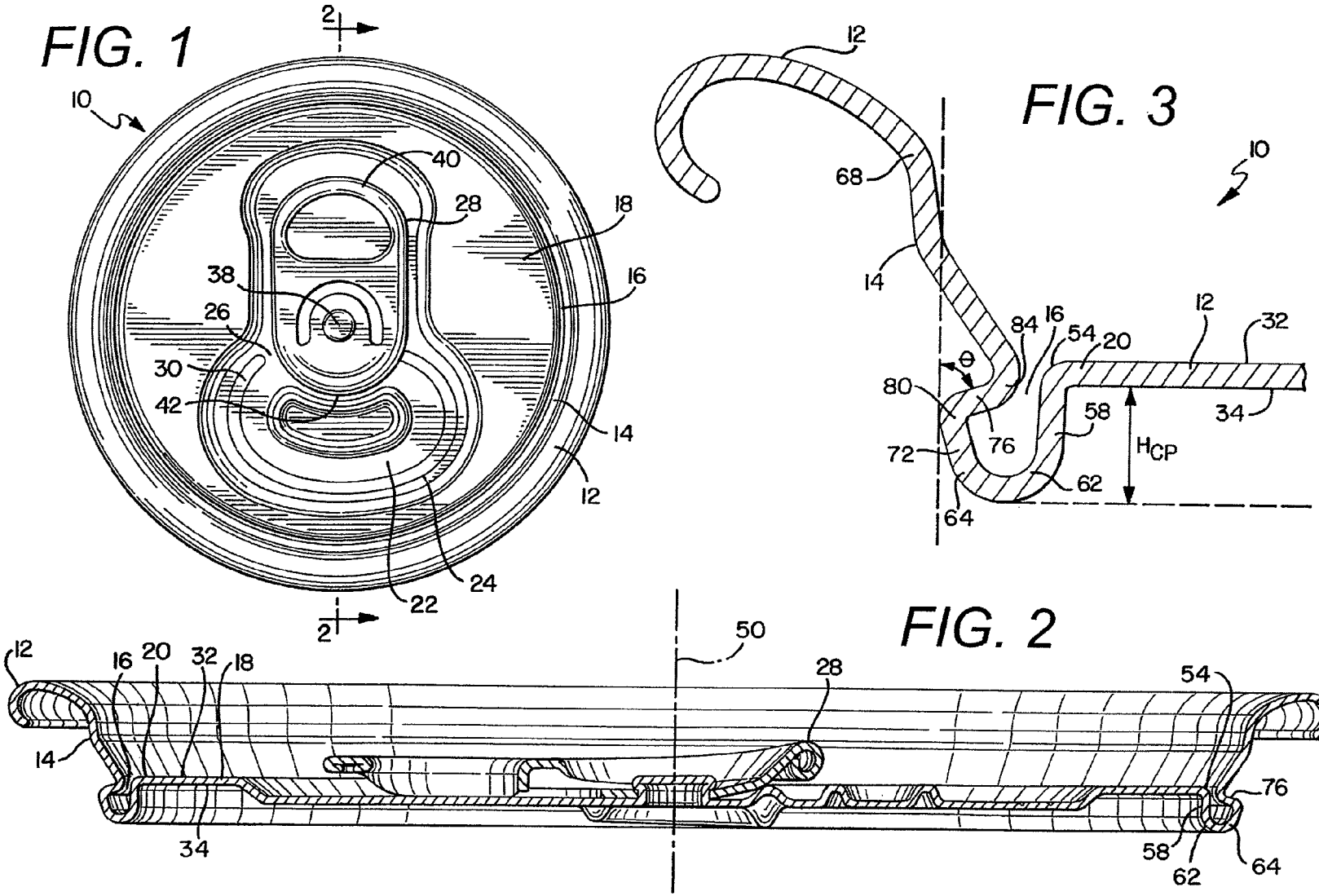
FIG. 1 is a top view of a can end of the present invention.
FIG. 2 is a cross-sectional view of the can end of FIG. 1.
FIG. 3 is magnified partial cross-sectional view of the can end of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

Referring to FIG. 1, the end member 10 for a container (not shown) has a curl 12, a circumferential wall 14, an annular countersink 16, and a center or central panel wall 18. The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the figures, the end member 10 is joined to a container by the curl 12 which is joined to a mating curl of the container body. The seaming curl 12 of the end closure 10 is integral with the circumferential wall 14 which is joined to a radially outer peripheral edge portion 20 of the center panel 18 by the annular countersink 16. This type of means for joining the end member 10 to a container body is presently the typical means for joining used in the industry, and the structure described above is formed in the process of forming the blank end from a cut edge of metal sheet, prior to the end conversion process. However, other means for joining the end member 10 to a container may be employed with the present invention.

The center panel 18 has a means for opening the end 10. The means for opening the end 10 may include a displaceable closure member or, as shown in FIG. 1, a tear panel 22 defined by a curvilinear frangible score 24 and a non-frangible hinge segment 26. The hinge segment 26 is defined by a generally straight line between a first end and a second end 30 of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into a public side 32 of the center panel 18. A residual is formed between the V-shaped groove and a product side 34 of the end member 10.

The end member 10 has a tab 28 secured to the center panel 18 adjacent the tear panel 22 by a rivet 38. The rivet 38 is formed in the typical manner.

During opening of the end member 10 by the user, the user lifts a lift end 40 of the tab 28 to displace a nose portion 42 downward against the tear panel 22. The force of the nose portion 42 against the tear panel 22 causes the score 24 to fracture. As the tab 28 displacement is continued, the fracture of the score 24 propagates around the tear panel 22, preferably in progression from the first end of the score 24 toward the second end 30 of the score 24.

Referring to FIGS. 2 and 3, the center panel 18 is centered about a longitudinal axis 50. The curl 12 defines an outer perimeter of the end member 10 and is integral with the circumferential wall 14. The circumferential wall 14 extends downwardly from the curl 12 at an angle. The circumferential wall 14 may be provided with a radius of curvature as shown in the drawings to improve performance within the forming tools used to form the end member 10. The radius of curvature helps prevent buckling within the tools as force is applied to the unfinished end member 10.

The center panel 18 has a height $H_{CP}$. The center panel height $H_{CP}$ is measured from a lowermost point on the annular countersink to the product side 34 of the peripheral edge 20 of the central panel 18.

The annular countersink 16 extends circumferentially about the center panel 18. One or more panel radii 54 join the radially outer edge 20 of the center panel 18 to a first portion inner wall 58 of the annular countersink 16. The inner wall 58 extends downwardly relative to the radially outer edge 20 of the center panel 18. The inner wall 58 may be angled with respect to a vertical axis on the order of ±10 degrees, i.e. angled radially inwardly or outwardly relative to the longitudinal axis 50. Accordingly, the inner wall 58 may extend downwardly and inwardly or downwardly and outwardly relative to the outer edge 20 of the center panel 18. The countersink 16 further has an arcuate second portion 62 extending radially outwardly and downwardly relative to the inner wall 58 and an arcuate third portion 64 extending upwardly relative to a lowermost end of the arcuate second portion 62.

The circumferential wall 14 joins the countersink 16 with the curl 12 such that an uppermost portion 68 of the wall 14 is directly connected to the curl 12 and a lowermost portion 72 of the wall 14 is directly connected to the third portion 64 of the countersink 16. Accordingly, the circumferential wall 14 extends upwardly from the countersink 16. The circumferential wall 14 may be angled outwardly relative to the longitudinal axis 50 or have an arcuate segment. In every case, however, prior to seaming, the circumferential wall 14 has an angled portion 76 The angled portion 76 is an inwardly protruding leg or portion of the lower portion of the circumferential wall, often called the outer countersink wall. This angled portion has a directionally inward shape or circumferentially inwardly reinforcing form. Accordingly, the angled portion 76 extends radially inwardly toward the center panel or relative to the longitudinal axis 50. The angle θ of the angled portion 76 is generally greater than 0 degrees as measured from a vertical axis. The angle may be greater than 25 degrees. However, the angle θ is preferably between 10 and 90 degrees; more preferably between 20 and 90 degrees, and most preferably between 60 and 90 degrees, or any range or combination of ranges between 0 and 180 degrees. The angle of the angled portion 76 is generally towards or in the direction of the inner wall 58 of the countersink and is not equal to an angle of the inner wall 58 of the countersink 16

The angled portion 76 is generally located between the lowermost end 72 of the circumferential wall 14 and the uppermost end 68 of the circumferential wall 14. Preferably, a lowermost end of the angled portion 76 has a height less than the height $H_{CP}$ of the center panel 18. Thus, the angled portion 76 may be angled towards the inner wall 58 of the countersink 16 wherein a distance or space between the circumferential wall 14 and the inner wall 58 of the annular countersink 16 is reduced along a length of the angled portion 76. In this way, the angled portion 76 approaches the inner wall 58 of the annular countersink 16 wherein a distance between the circumferential wall 14 and the inner wall 58 is reduced along at least a length of the angled portion 76. Further, a length of the angled portion 76 is less than the length of the inner wall 58 of the annular countersink 16.

The angled portion 76 is bounded by a first bend 80 interconnected to a second bend 84. The first bend 80 is inwardly concave relative to the public side 32 of the end 10. This orientation of the first bend 80 directs the angled portion 76 inwardly relative to longitudinal axis 50. Conversely, the second bend 84 is outwardly convex relative to the public side 32 of the end 10. The orientation of the second bend 84 directs the remaining upper portion of the circumferential wall 14 upwardly and optionally outwardly relative to the longitudinal axis 50.

Stated another way, the circumferential wall 14 has a first part 72 extending upwardly and outwardly from an annular arcuate portion 64 of the countersink 16. The first part 72 is directly connected to a second part 80 having a concave curvature relative to the public side 32 of the can end 10. A third part 76 has a negative angle, i.e. angled inwardly relative to a vertical axis, and extends upwardly and inwardly relative to the longitudinal axis 50. The third part 76 is directly connected to a fourth part 84 having a convex curvature relative to the public side 32 of the can end 10. The fourth part 84 is directly connected to an upper portion of the circumferential wall 14 which extends upwardly and outwardly relative to longitudinal axis. An uppermost portion of the circumferential wall 68 is directly connected to the curl 12.

The curl 12 is located radially outwardly relative to the center panel 18 and defines an outer perimeter of the end 10. The curl 12 has an inner arcuate portion directly connected to an uppermost portion 68 of the circumferential wall 16 and an outer portion that extends outwardly relative to the longitudinal axis 50.

While the specific embodiments have been illustrated and described, numerous modifications come to mind without significantly departing from the spirit of the invention, and the scope of protection is only limited by the scope of the accompanying Claims.

What is claimed is:

1. An end for a beverage can, the end having a product side and an opposing public side, the end comprising:

a center panel including a means for opening the end comprising a tear panel defined by a curvilinear frangible score and a non-frangible hinge segment and a tab secured to the center panel adjacent the tear panel by a rivet;

an annular countersink extending circumferentially about the center panel;

a circumferential wall extending upwardly from the countersink, the circumferential wall having an angled portion extending radially inwardly toward the center panel wherein the angled portion is bounded by a first bend interconnected to a second bend, the first bend being inwardly concave relative to the public side of the end, and the second bend being outwardly convex relative to the public side of the end wherein the angled portion extending radially inwardly toward the center panel has an angle between 60 and 90 degrees as measured from a vertical axis; and a curl located radially outward relative to the center panel and a radially outermost portion of which defines an outer perimeter of the end.

2. The end of claim 1 wherein the annular countersink has a first portion extending downwardly relative to a radially outer edge of the center panel, an arcuate second portion extending radially outwardly and downwardly relative to the first portion, and an arcuate third portion extending upwardly relative to a lowermost end of the arcuate second portion, a lowermost end of the circumferential wall is joined to the third portion, the angled portion being located between the lowermost end of the circumferential wall and an uppermost end of the circumferential wall joined to the curl.

3. The end of claim 2 wherein the angled portion of the circumferential wall is angled towards the first portion of the countersink wherein a distance between the circumferential wall and the first portion of the annular countersink is reduced along a length of the angled portion.

4. The end of claim 2 wherein an angle of the first portion of the annular countersink is not equal to an angle of the angled portion of the circumferential wall.

5. The end of claim 2 wherein a length of the angled portion is less than a length of the first portion of the annular countersink.

6. The end of claim 1 wherein the central panel has a height measured from a lowermost point on the annular countersink to the public side of a peripheral edge of the central panel and wherein a lowermost end of the angled portion of the circumferential wall has a height less than the height of the center panel.

7. An end for a beverage can, the end having a public side and an opposing product side, the end comprising:

a center panel extending radially outwardly from a central longitudinal axis, the center panel including a means for opening the end comprising a tear panel defined by a curvilinear frangible score and a non-frangible hinge segment and a tab secured to the center panel adjacent the tear panel by a rivet;

an annular countersink extending circumferentially about a radially outer edge of the center panel, the annular countersink having a first portion extending downwardly relative to the radially outer edge of the center panel, an arcuate second portion extending radially outwardly and downwardly relative to the first portion, and an arcuate third portion extending upwardly relative to a lowermost end of the arcuate second portion, the first portion angled ±10 degrees from a vertical axis;

a circumferential wall extending upwardly from the annular countersink and spaced a distance from the first portion of the annular countersink, the circumferential wall having an angled portion extending radially inwardly relative to the longitudinal axis, wherein the angled portion is bounded by a first bend interconnected to a second bend, the first bend being inwardly concave relative to the public side of the end, and the second bend being outwardly convex relative to the public side of the end and the angled portion being a distinctly separate circumferential inwardly reinforcing form relative to the first and second bends; and a curl located radially outward relative to the center panel and a radially outermost portion of which defines an outer perimeter of the end.

8. The end of claim 7 wherein the angled portion of the circumferential wall approaches the first portion of the annular countersink wherein a distance between the circumferential wall and the first portion of the annular countersink is reduced along at least a length of the angled portion.

9. The end of claim 7 wherein the angled portion of the circumferential wall is angled towards the first portion of the annular countersink.

10. The end of claim 7 wherein the central panel has a height measured from a lowermost point on the annular countersink to the product side of a peripheral edge of the central panel and wherein a lowermost end of the angled portion of the circumferential wall has a height less than the height of the center panel.

11. The end of claim 7 wherein an angle of the first portion of the annular countersink is not equal to an angle of the angled portion of the circumferential wall.

12. An end for a beverage can, the end having a public side and an opposing product side, the end comprising:

a center panel including a means for opening the end located on the public side of the end comprising a tear panel defined by a curvilinear frangible score and a non-frangible hinge segment and a tab secured to the center panel adjacent the tear panel by a rivet;

an annular countersink extending circumferentially about a radially outer edge of the center panel, the annular countersink having a first portion extending downwardly relative to the radially outer edge of the center panel, an arcuate second portion extending radially outwardly and downwardly relative to the first portion, and an arcuate third portion extending upwardly relative to a lowermost end of the arcuate second portion;

a circumferential wall extending upwardly from the annular countersink, the circumferential wall having a first bend inwardly concave relative to the public side and a second bend outwardly convex relative to the public side, the first bend separated from the second bend by a segment of the circumferential wall, the segment extending upwardly and radially inwardly and having an angle greater than 0 degrees and less than 90 degrees as measured from a vertical axis forming an inwardly protruding leg wherein the inwardly protruding leg forms a separate distinct part of the circumferential wall relative to the first and second bends; and an annular curl located radially outward relative to the center panel and a radially outermost portion of which defines an outer perimeter of the end, the annular curl having a curved portion joined to an uppermost portion of the circumferential wall and extending upwardly and radially outwardly therefrom.

* * * * *